US009822616B2

(12) United States Patent
Dotson

(10) Patent No.: US 9,822,616 B2
(45) Date of Patent: Nov. 21, 2017

(54) PRESSURE ACTUATED FLOW CONTROL IN AN ABRASIVE JET PERFORATING TOOL

(71) Applicant: TD Tools, Inc., Woodburn, KY (US)

(72) Inventor: Thomas L. Dotson, Woodburn, KY (US)

(73) Assignee: TD TOOLS, INC., Woodburn, KY (US)

( * ) Notice: Subject to any disclaimer, the term of this patent is extended or adjusted under 35 U.S.C. 154(b) by 336 days.

(21) Appl. No.: 14/664,326

(22) Filed: Mar. 20, 2015

(65) Prior Publication Data

US 2015/0267514 A1 Sep. 24, 2015

Related U.S. Application Data

(60) Provisional application No. 61/968,435, filed on Mar. 21, 2014.

(51) Int. Cl.
*E21B 41/00* (2006.01)
*E21B 43/114* (2006.01)

(52) U.S. Cl.
CPC ..... *E21B 43/114* (2013.01); *E21B 41/0078* (2013.01)

(58) Field of Classification Search
CPC ... E21B 43/114; E21B 34/063; E21B 41/0078
See application file for complete search history.

(56) References Cited

U.S. PATENT DOCUMENTS 2,494,256 A 1/1950 Muskat et al.
3,066,735 A 12/1962 Zingg
3,130,786 A 4/1964 Brown et al.
3,266,571 A 8/1966 St. John et al.
4,669,999 A 6/1987 Miller
5,215,148 A 6/1993 Ricles
5,533,571 A 7/1996 Surjaatmadja et al.
6,085,843 A 7/2000 Edwards et al.
6,142,231 A 11/2000 Myers, Jr. et al.
7,832,481 B2 * 11/2010 Martindale ..... B24C 1/045 166/298
8,066,059 B2 11/2011 Ferguson et al.
8,210,250 B2 7/2012 Ferguson et al.
8,393,392 B2 3/2013 Mytopher et al.
8,403,049 B2 3/2013 Ferguson et al.
(Continued)

FOREIGN PATENT DOCUMENTS

WO 2013/187905 A1 12/2013

OTHER PUBLICATIONS

Cobbett, J.S., "Sand Jet Perforating Revisited" Society of Petroleum Engineers Drilling & Completion, Mar. 1999, vol. 14, No. 1, pp. 28-33.

*Primary Examiner* — Daniel P Stephenson

(74) *Attorney, Agent, or Firm* — Norton Rose Fulbright US LLP

(57) ABSTRACT

There is disclosed herein a method and apparatus for using rupture pins to selectively open jets on a jet perforating tool. Rupture pins inserted in jets within a jet perforating tool are configured to rupture at pre-designed thresholds, thereby opening the jet to begin a perforating job, or to circulate fluid through the tool. Also disclosed are systems and methods for holding the rupture pins within the tool prior to rupture.

22 Claims, 7 Drawing Sheets

(56) References Cited

U.S. PATENT DOCUMENTS

| | | | | |
|---|---|---|---|---|
| 8,555,960 | B2 | 10/2013 | Mailand et al. | |
| 9,133,694 | B2 * | 9/2015 | Lyashkov | E21B 43/119 |
| 2004/0089450 | A1 * | 5/2004 | Slade | B24C 1/045 166/298 |
| 2010/0212903 | A1 | 8/2010 | Dotson et al. | |
| 2011/0017453 | A1 | 1/2011 | Mytopher et al. | |
| 2011/0155377 | A1 * | 6/2011 | Laun | E21B 33/12 166/308.1 |
| 2014/0158357 | A1 | 6/2014 | Lyashkov et al. | |
| 2015/0260012 | A1 * | 9/2015 | Themig | E21B 34/14 166/374 |
| 2015/0267514 | A1 * | 9/2015 | Dotson | E21B 41/0078 166/297 |

* cited by examiner

PRESSURE ACTUATED FLOW CONTROL IN AN ABRASIVE JET PERFORATING TOOL

CROSS REFERENCE

The present application claims priority to U.S. provisional application Ser. No. 61/968,435, which was filed on Mar. 21, 2014, entitled Pressure Actuated Flow Control in an Abrasive Jet Perforating Tool, the disclosure of which is incorporated by reference herein in its entirety.

FIELD OF INVENTION

This invention relates generally to the field of treating wells to stimulate fluid production. More particularly, the invention relates to the field of high pressure abrasive fluid injection in oil and gas wells.

BACKGROUND OF THE INVENTION

Abrasive jet perforating uses fluid slurry pumped under high pressure to perforate tubular goods around a wellbore, where the tubular goods include tubing, casing, and cement. Since sand is the most common abrasive used, this technique is also known as sand jet perforating (SJP). Abrasive jet perforating was originally used to extend a cavity into the surrounding reservoir to stimulate fluid production. It was soon discovered, however, that abrasive jet perforating could not only perforate, but cut (completely sever) the tubular goods into two pieces. Sand laden fluids were first used to cut well casing in 1939. Abrasive jet perforating was eventually attempted on a commercial scale in the 1960s. While abrasive jet perforating was a technical success (over 5,000 wells were treated), it was not an economic success. The tool life in abrasive jet perforating was measured in only minutes and fluid pressures high enough to cut casing were difficult to maintain with pumps available at the time. A competing technology, explosive shape charge perforators, emerged at this time and offered less expensive perforating options.

Consequently, very little work was performed with abrasive jet perforating technology until the late 1990's. Then, more abrasive-resistant materials used in the construction of the perforating tools and jet orifices provided longer tool life, measured in hours or days instead of minutes. Also, advancements in pump materials and technology enabled pumps to handle the abrasive fluids under high pressures for longer periods of time. The combination of these advances made the abrasive jet perforating process more cost effective. Additionally, the recent use of coiled tubing to convey the abrasive jet perforating tool down a wellbore has led to reduced run time at greater depth. Further, abrasive jet perforating did not require explosives and thus avoids the accompanying danger involved in the storage, transport, and use of explosives. However, the basic design of abrasive jet perforating tools used today has not changed significantly from those used in the 1960's.

Abrasive jet perforating tools and casing cutters were initially designed and built in the 1960's. There were many variables involved in the design of these tools. Some tool designs varied the number of jet locations on the tool body, from as few as two jets to as many as 12 jets. The tool designs also varied the placement of those jets, such, for example, positioning two opposing jets spaced 180° apart on the same horizontal plane, three jets spaced 120° apart on the same horizontal plane, or three jets offset vertically by 30°. Other tool designs manipulated the jet by orienting it at an angle other than perpendicular to the casing or by allowing the jet to move toward the casing when fluid pressure was applied to the tool.

Abrasive jet perforating may be used in combination with various steps during well completion, stimulation, and intervention to reduce a number of trips in and out of the well, which can lower completion costs. Costs may be further decreased when equipment, in a single trip downhole, may accomplish multiple functions.

Abrasive jet perforating tools may include multiple openings into which threaded ports, referred to as jets, may be inserted or screwed. Having the ability to selectively open fluid flow to certain jet locations may aid in allowing an abrasive jet perforating tool to perform multiple functions, such as setting a plug/packer or using a fluid pulse type data delivery system. According to the state of the art, selective opening of various jets on a perforating tool is accomplished by sliding a sleeve across the fluid opening inside the inner diameter of the tool. The sliding sleeve is actuated to open a fluid path through the tool to particular jets. Sliding sleeves, however, present numerous drawbacks. First, the overall inner diameter of the tool is decreased, which can cause problems with pressure loss through the tool due to friction. Second, it could prevent a drop ball from being used in a tool located below the perforator. Third, it requires the complete disassembly of the tool to reset the sleeve. With rupture pins, the jet can be removed from the tool and another pin inserted without removing the tool from the assembly.

As disclosed herein, there is a method and apparatus for using rupture pins to selectively open jets on a perforating tool.

SUMMARY

Abrasive jet perforating tools introduce abrasive slurry at high pressures through one or more jets located in the tool. In certain situations, it may be advantageous to open different jets at different times in a perforating job. Conventional methods of opening jets can be complex, expensive, and prone to failure. Therefore, disclosed herein is a method and apparatus for using rupture pins to selectively opening jets on a perforating tool.

Rupture pins, inserted in the jet of a perforating jet tool are configured to break when a threshold fluid pressure is applied to the jet perforating tool, according to one embodiment presented. Multiple jets are contemplated, with multiple rupture pins. Rupture pins may be configured to rupture at different pressures, thereby giving tool operator the means to selectively open jets.

According to one embodiment, rupture pins are inserted from the inside annulus of a jet perforating tool through the jet toward the external surface. The rupture pins may be held in the tool by positive pressure, by chemical bonding, or by affixing a pin fastener or a mating piece designed to hold the rupture pins in the jet perforating tool. As disclosed herein, when the rupture pin ruptures, a lower portion of the rupture pin is ejected from the jet perforating tool, where it can fall down in the wellbore out of the way of the perforation or fracking operation. For embodiments containing a mating piece or pin faster, the mating piece and/or fastener is ejected with the lower portion of the rupture pin.

According to one embodiment, there is provided an apparatus comprising a jet perforating tool comprising a plurality of jets, and a first rupture pin inserted in a first jet of the plurality of jets to seal the first jet, wherein the first rupture pin is configured to rupture when a fluid pressure greater than a first threshold pressure is applied to the jet perforating tool. In one embodiment, the rupture pin is attached to the jet through a chemical compound. In another, the rupture pin is mechanically attached to the first jet. In another, the rupture pin is mechanically attached to the first jet by a pin fastener. It can also be attached by a mating piece.

In one embodiment, the apparatus further comprises a second rupture pin inserted in a second jet of the plurality of jets to seal the second jet, wherein the second rupture pin is configured to rupture when a fluid pressure greater than a second threshold pressure is applied to the jet perforating tool. In one embodiment, the rupture pin of the apparatus comprises an upper portion, and a lower portion, the lower portion being configured to separate from the upper portion and eject from the jet when the fluid pressure exceeds the first threshold pressure.

In one embodiment, there is provided a first rupture pin that further comprises an undercut portion between the upper portion and the lower portion, the undercut portion configured to break when the fluid pressure exceeds the first threshold pressure. The first jet may comprise a threaded jet, but in another embodiment, abrasive jets are mounted in smooth holes drilled into the side of the jet perforating too, and protective plates are mounted thereafter surrounding the abrasive jets to hold them in place. In one embodiment, the first rupture pin comprises material selected from brass, tin, silver, zinc, copper, aluminum, magnesium, gallium, thorium, and gold.

Also disclosed herein is a rupture pin comprising an upper portion, and a lower portion, wherein the upper portion and the lower portion are coupled together by an undercut region, the undercut region having a smaller diameter than the upper portion and the lower portion. In one embodiment, the undercut region is configured to break when a fluid pressure is applied to the rupture pin that exceeds a first threshold pressure. In one embodiment, the upper portion comprises an opening to allow fluid flow through the upper portion. In another, the lower portion comprises an opening configured to receive a mating piece for securing the apparatus into a jet of a jet perforating tool. In still another embodiment, the lower portion comprises threads configured to receive a pin fastener for securing the apparatus into a jet of a jet perforating tool.

Also disclosed herein is a method comprising inserting a jet perforating tool into a well, the jet perforating tool comprising one or more jets, wherein at least one of the one or more jets comprises a first rupture pin, flowing a first fluid to the jet perforating tool at a first pressure, and increasing the pressure of the first fluid to a second pressure, wherein the second pressure is greater than a rupture threshold of the first rupture pin. The first fluid can be a non-abrasive fluid. In one embodiment, the method further comprises flowing a second fluid to the jet perforating tool after the first rupture pin is ruptured, wherein the second fluid comprises abrasive fluid. In another embodiment, the at least one of the one or more jets comprise a second rupture pin, the method further comprising increasing the pressure of the first fluid to a third pressure, wherein the third pressure is greater than a rupture threshold of the second rupture pin.

Also disclosed is an apparatus comprising a jet perforating tool comprising a plurality of jets, a first rupture pin inserted in a first jet of the plurality of jets, wherein the first rupture pin is configured to seal the first jet until a fluid pressure greater than a first threshold pressure is applied to the jet perforating tool, and means for securing the first rupture pin in the first jet of the plurality of jets. In one embodiment, the securing means comprises a chemical compound. In another, the securing means comprises a pin fastener, and in another, it comprises a mating piece.

The foregoing has outlined rather broadly the features and technical advantages of the present disclosure in order that the detailed description that follows may be better understood. Additional features and advantages will be described hereinafter which form the subject of the claims herein. It should be appreciated by those skilled in the art that the conception and specific embodiments disclosed may be readily utilized as a basis for modifying or designing other structures for carrying out the same purposes of the present designs. It should also be realized by those skilled in the art that such equivalent constructions do not depart from the spirit and scope as set forth in the appended claims. The novel features which are believed to be characteristic of the designs disclosed herein, both as to the organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present invention, reference is now made to the following descriptions taken in conjunction with the accompanying drawing(s), in which.

DETAILED DESCRIPTION

Figure 5A:
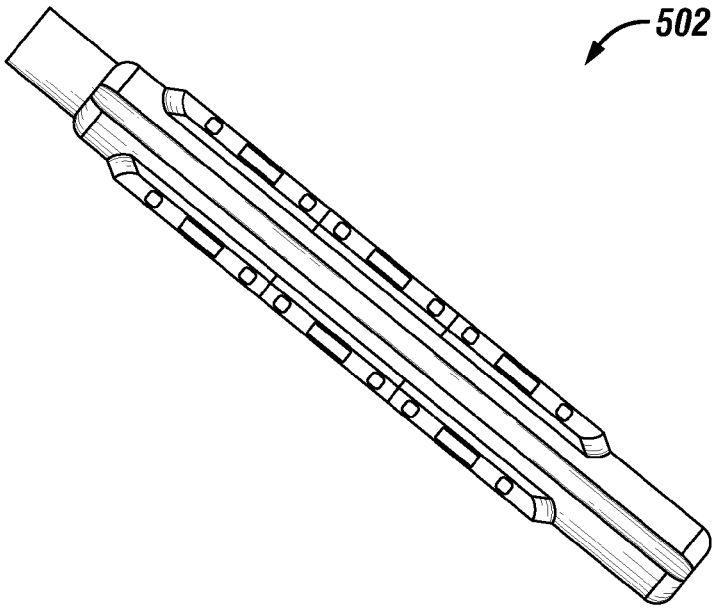
FIGS. 5A-B show abrasive jet perforating tools according to embodiments of the present disclosure.
Figure 5B:
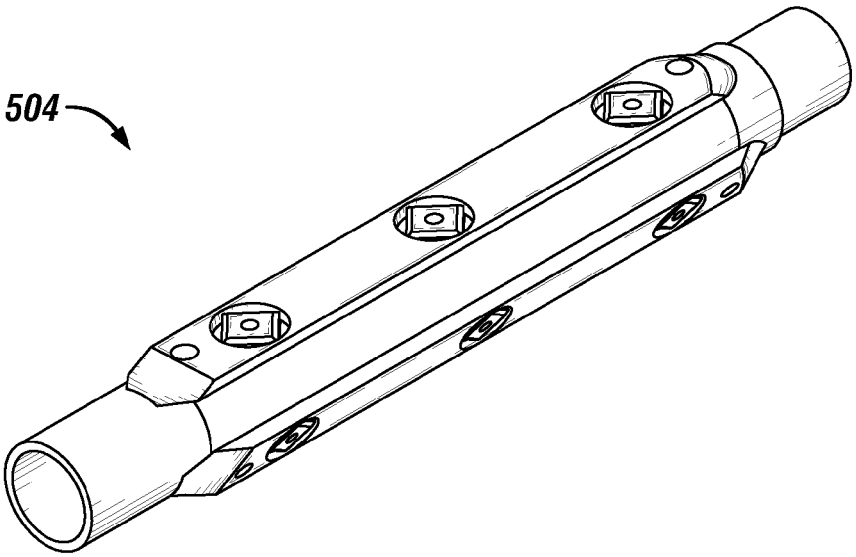
Figure 6A:
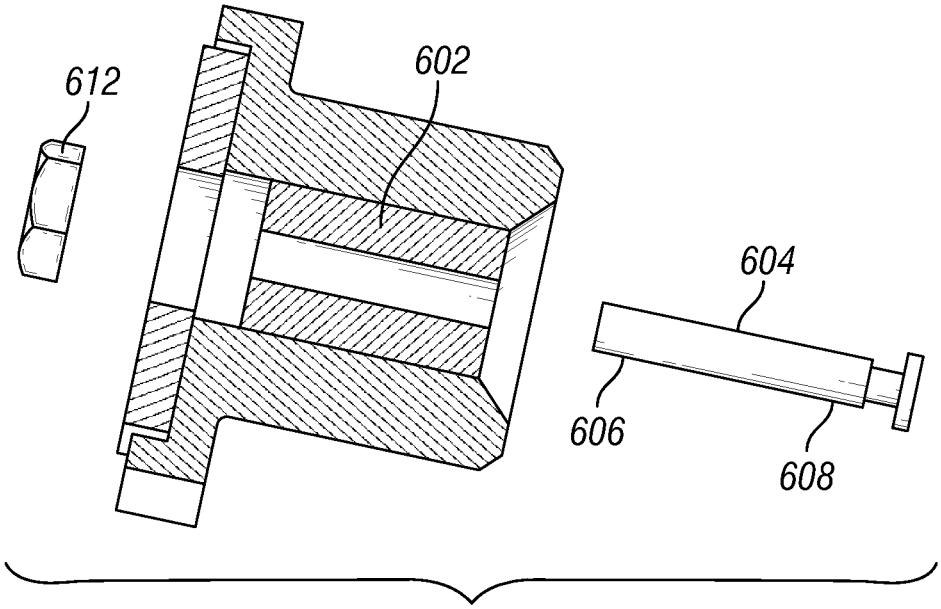
FIGS. 6A-B show cutaway views of a rupture pin of the present disclosure with a pin fastener.
Figure 6B:
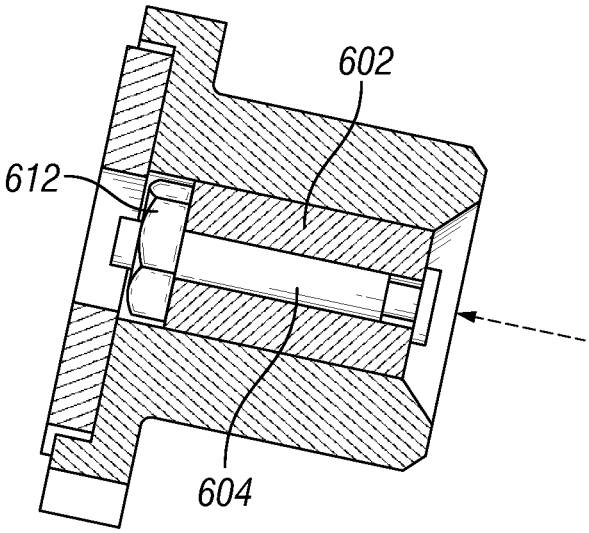

Abrasive jet perforating tools introduce abrasive slurry at high pressures through one or more jets located in the tool. According to one design, multiple jets can be contained within one tool. FIGS. 5A and 5B show two representations of conventional abrasive jet perforating tools with multiple jets. For example, the tool in FIG. 5B contains three jets per tool face, with two or more faces on the tool. In certain situations, it may be advantageous to open different jets at different times in a perforating job. Disclosed herein are systems and methods for using different fluid flows or pressures to operate an abrasive jet perforating tool. Opening jet locations at different pressures may aid in the operation of a perforating job.

In one embodiment, a rupture pin is inserted in jets of an abrasive jet perforating tool before lowering the jet perforating tool into the well. Each rupture pin, while intact, seals a corresponding jet, or restricts the flow thereto. The rupture pins are configured to break when a threshold fluid pressure is applied to the jet perforating tool. The threshold pressure may cause the rupture pin to split into an upper portion and a lower portion. The lower portion may flow out of the jets, clearing the jets to allow the fluid to flow through the jets. The upper portion, according to one embodiment, is configured to disintegrate in the abrasive fluid, such that little to none of the rupture pin remains after the pressure threshold is reached.

In tools that contain multiple jets, multiple corresponding rupture pins are contemplated. Each rupture pin can have a different threshold pressure for rupture, or banks of pins can be configured to rupture at certain pressure ranges.

The rupture pin may be a generally cylindrically-shaped tube having an upper portion and a lower portion, in which the upper portion has a larger outer diameter than the lower portion. The inner diameter of the tube may or may not be a complete through hole. The rupture pin may be manufactured from a material with desired tensile strength properties and with a wall thickness selected to shear at a desired pressure differential. The rupture pin may be used in any device with openings, including downhole tools with abrasive jetting orifices, such as an abrasive jet perforating tool.

Figure 1A:
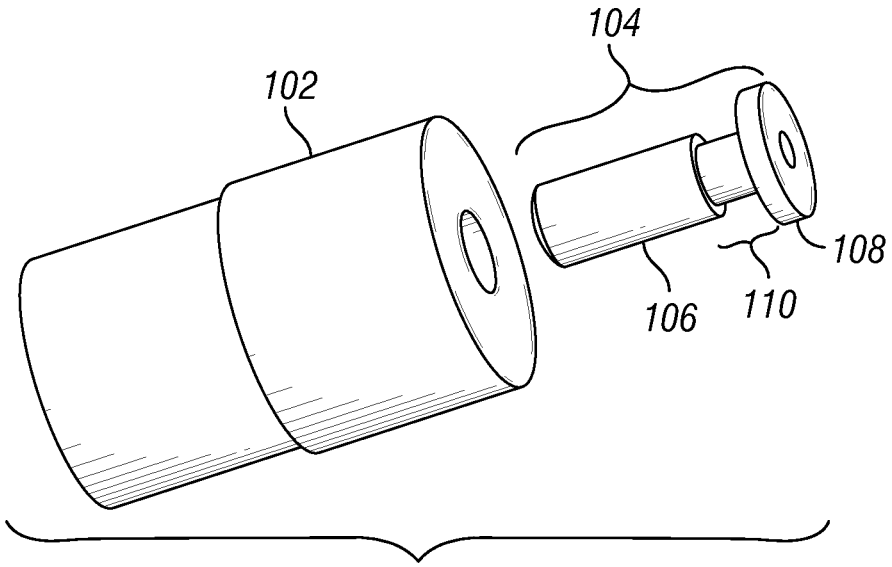
FIGS. 1A-B depict an abrasive jetting insert and rupture pin, with a cutaway view, according to one embodiment of the disclosure.
Figure 1B:
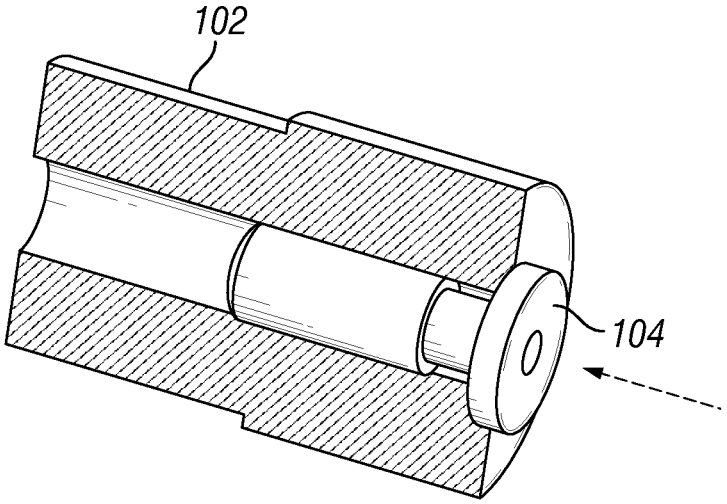

FIGS. 1A-B and 2A-B are illustrations of a rupture pin according to various embodiments of the disclosure. In this embodiment, a rupture pin 104, 204 includes a lower portion 106, 206 and an upper portion 108, 208. The lower portion 106, 206 may be coupled to the upper portion 108, 208 through an undercut portion 110, 210. The undercut portion 110, 210 has a smaller diameter than either the lower portion 106, 206 or the upper portion 108, 208. The rupture pin 104, 204 may be manufactured from materials such as brass, tin, silver, zinc, copper, aluminum, magnesium, gallium, thorium, gold, and/or other low shear strength materials with good machinability Likewise, combinations of said materials are contemplated, as well as alloys. According to one embodiment, rupture pin 104, 204 is fashioned from a material having a consistent tensile strength, resistance to chemicals potentially found in the well, and/or a high temperature tolerance. Rupture pins 104, 204 are designed to fit inside the jet orifices themselves. Therefore, the lower portion 106, 206 may have a diameter, in one embodiment, between approximately 0.100 inches and 0.250 inches. Upper portion 108, 208 according to one embodiment, has a larger diameter and is designed to rest on the inside of the jet, as seen in FIG. 1B.

Rupture pin 104, 204, according to the embodiment shown in FIGS. 1A-B and 2A-B, comprises a hollow portion running through upper portion 110, 210, undercut portion 110, 210, and into lower portion 106, 206. When fluid pressure is applied to abrasive jet perforating tool 500, fluid fills the hollow portion of rupture pin 104, 204, enacting pressure on lower portion 106, 206, which in turn stresses undercut portion 110, 210. With enough pressure, undercut portion 110, 210 breaks, rupturing the pin.

Figure 2A:
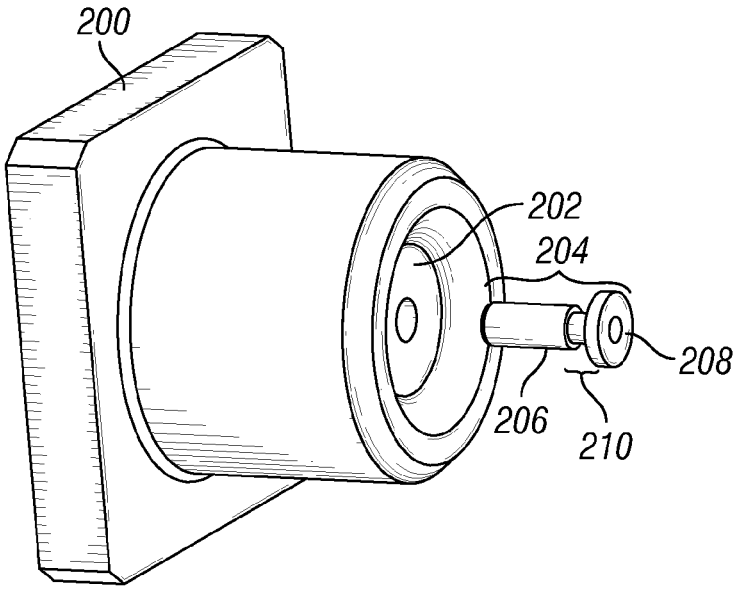
FIGS. 2A-B depict an abrasive jetting insert and rupture pin, with a cutaway view, according to one embodiment of the disclosure.
Figure 2B:
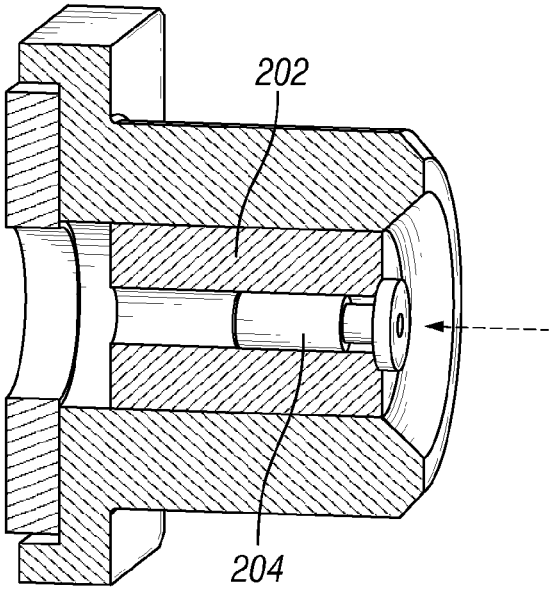

FIGS. 2A-B represent an alternative jet design. The interior portion of abrasive jet 200 is recessed so that upper portion 208 of rupture pin 204 becomes inset. This protects upper portion 208 from abrasive slurry that may be directed to other abrasive jets 200.

According to one embodiment, the thickness and/or wall thickness of the undercut portion 110, 210 of rupture pin 104, 204 is selected such that the undercut portion 110, 210 breaks or shears under stress from an applied fluid pressure. The lower portion 106, 206, the upper portion 108, 208, and the undercut portion 110, 210 may be molded as a single piece, with the undercut portion 110, 210 later machined to the desired diameter. The material composition of the rupture pin 104, 204, including the undercut portion 110, 210, may additionally or alternatively be adjusted to achieve rupture of the rupture pin 104, 204 at a desired pressure. For example, rupture pin 104, 204 may be fabricated with a rupture section having a different porosity than upper portion 108, 208 and lower portion 106, 206, wherein the change in porosity facilitates the rupture at a desired threshold pressure. In an alternate embodiment, the rupture portion is mechanically scarred to facilitate rupture. In yet another embodiment, rupture pin 104, 204 has a graduated change in material make-up configured to create a region of lower shear strength at a desired point. Rupture pins 104, 204 of this nature can be fabricated through several means, such as casting and injection molding. One of ordinary skill in the art of material science would have knowledge in fabrication methods.

When a sufficient fluid pressure is applied to the rupture pin 104, 204, the rupture pin 104, 204 breaks, such as by shearing, to allow the lower portion 106, 206 to flow through the abrasive jetting insert 202 and allow fluid to flow through the abrasive jetting insert 202. Fluid pressure exerted on the upper portion 108, 208 and/or the undercut region 110, 210 may cause the lower portion 106, 206 to separate from the upper portion 108, 208. For example, the pressure may shear the undercut region 110, 210. The fluid pressure may then push the lower portion 106, 206 through the abrasive jetting insert 102, 202 and/or the abrasive jet 200. With the lower portion 106, 206 cleared from the abrasive jetting insert 102, 202 and/or the abrasive jet 200, fluid is free to flow through the insert 102, 202 and/or the jet 200. The upper portion 108, 208 may remain on an inside of the insert 102, 202, but an opening in the upper portion 108, 208 may allow fluid to flow through the insert 102, 202. When the fluid flow through the opening is an abrasive fluid, the upper portion 108, 208 may disintegrate in an abrasive fluid.

Figure 3:
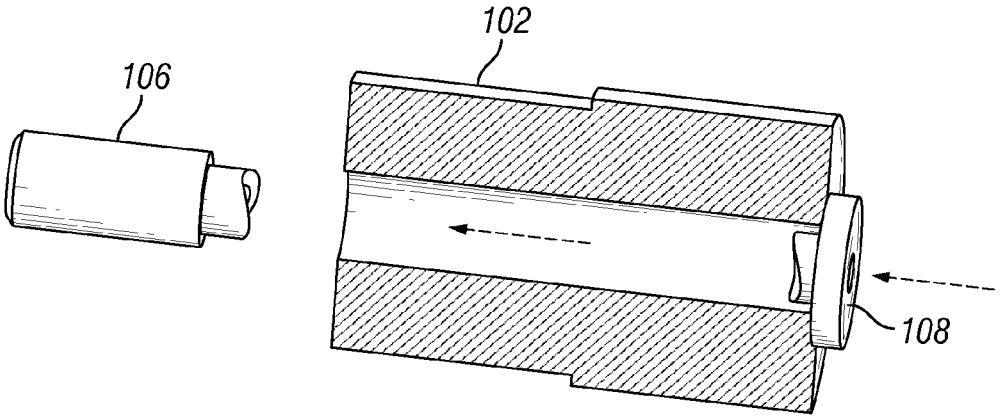
FIG. 3 shows a post-rupture cutaway view of one embodiment of the present disclosure.

FIG. 3 shows a cut-away view of one embodiment of rupture pin 104 just after rupture. High pressure fluid is applied to abrasive jet perforating tool, and in turn presses on abrasive jets 200. As pressure builds, strains rupture pin 104, pushing lower portion 106 away from the abrasive jet perforating tool center. Eventually, the strain on rupture pin 104 breaks the rupture pin in the undercut portion 110 region. Lower portion 106 is ejected from jet insert 102 and falls down in the casing or wellbore. Fluid then begins to flow through the hollow portion of upper portion 108 and what is left of undercut portion 110. As the abrasive slurry makes it way down to jet insert 102 and rupture pin 104, it begins to eat away the material of rupture pin 104, opening the center hole region of upper portion 108. According to one test, abrasive slurry contact can disintegrate the remaining part of rupture pin 104 in as little as 30 seconds, such that abrasive jet 200 is operating at full capacity.

Figure 4:
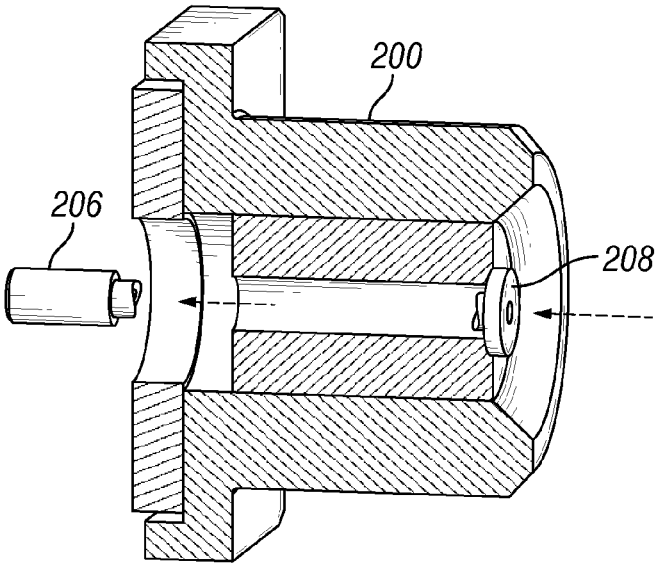
FIG. 4 shows a post-rupture cutaway view of another embodiment of the present disclosure.

FIG. 4 shows a cut-away view of another embodiment of the disclosure. Rupture pin 204 is inset into the recessed portion of abrasive jet 200. Fluid pressure applied to rupture pin 204 translates to lower portion 206 until the strain breaks undercut portion 210. Lower portion 206 is then ejected from abrasive jet 200 and the jet begins to function. Upper portion 208 and remaining undercut portion 210 are eroded by the abrasive slurry so that jet 200 begins to function at full capacity.

The rupture pin described herein may be used in various tools, including tools for well completion, such as various abrasive jet perforating tools displayed in FIGS. 5A-B. FIGS. 5A-B are profile views of jet perforating tools with jets according to various embodiments of the disclosure. A perforating tool 502 may be, for example, a slim hole tool having jets with outer diameters of between approximately 2.25 inches and 2.5 inches. In one embodiment, threaded jets are screwed into tool 502, for example, with threaded jets having an outer diameter of approximately 3.5 inches to 5.5 inches. In another embodiment, such as shown in FIG. 5A, abrasive jets are mounted in smooth holes drilled into the side of tool 502, and protective plates are mounted thereafter surrounding the abrasive jets to hold them in place. Rupture pins as described herein may be used in either of the tools 502 or 504 or other tools not illustrated here. The rupture pins may be adapted for various openings sizes across any type of tool and operating pressures of the tools. Additional details regarding perforating tools may be found in U.S. Pat. No. 7,963,332, which describes, in one embodiment, a threaded jet with carbide insert, and may be found in U.S. Patent Publication No. 2014/0102705, which describes in one embodiment, a carbide jet, both of which are incorporated by reference in their entirety.

Once inserted, rupture pins remain in the tool under positive pressure exerted from the inside of the tool outward. They may also be glued or cemented in place, such as, for example, by use of a chemical compound adhesive. The chemical compound may have a high temperature rating, be resistant to other chemicals found in the well, and/or have a consistent strength without affecting the shearing capabilities of the pin. Where it is desireable for different jets to open at different times, however, pressure built up in the casing or wellbore from an open jet may impart pressure on the intact rupture pins of other jets, forcing them backward into the tool. To avoid this, there are presented methods and systems for fixing the rupture pins in a jet.

The rupture pin may also or alternatively be held in the abrasive jetting insert by mechanical means, such as a pin fastener and/or a mating piece as shown in FIGS. 6-9. FIGS. 6A-B represent a cut-away view of a jet showing assembly of a rupture pin with a pin fastener according to one embodiment of the disclosure. An abrasive jetting insert 602 may have a jet into which a rupture pin 604 is inserted. In this embodiment, the rupture pin 604 includes a lower portion 606 and an upper portion 608. A pin fastener 612 may be attached to an end of the rupture pin 604 to hold the rupture pin 604 in the jet. In the embodiment shown in FIG. 6A, the pin fastener 612 is a nut that attaches to the base of lower portion 606. According to one embodiment, the rupture pin 604 may be threaded on a lower portion 606 to allow the pin fastener 612 to screw onto the rupture pin 604.

Figure 7:
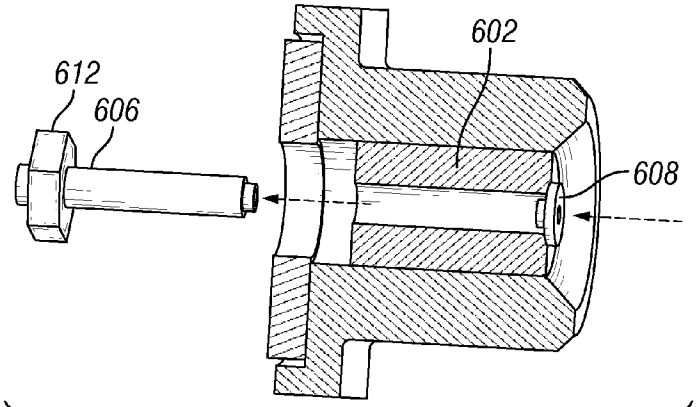
FIG. 7 represents a post-rupture cutaway view of a rupture pin of the present disclosure.

The pin fastener 612 may provide an opposing force that prevents the rupture pin 604 from falling out the back of the jet of the abrasive jetting insert 602 and into fluid flow. The pin fastener 612, for example, holds the rupture pin 604 in place during transport of the jet perforating tool containing the abrasive jetting insert 602 or during times of low fluid pressure in the jet perforating tool containing the abrasive jetting insert 602. FIG. 7 is a cut-away view of a jet showing rupture of a rupture pin previously attached with a pin fastener according to one embodiment of the disclosure. When high pressure builds causing rupture pin 604 to shear, lower portion 606 along with pin fastener 612 are ejected from abrasive jet 602.

Figure 8B:
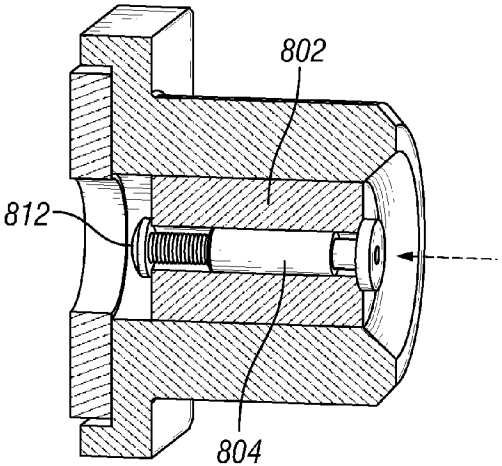
FIGS. 8A-B show cutaway views of a rupture pin of the present disclosure with a mating piece.
Figure 8A:
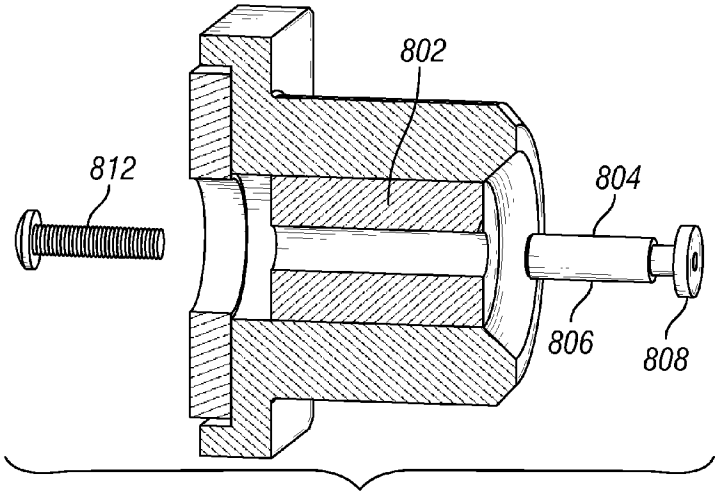
Figure 9:
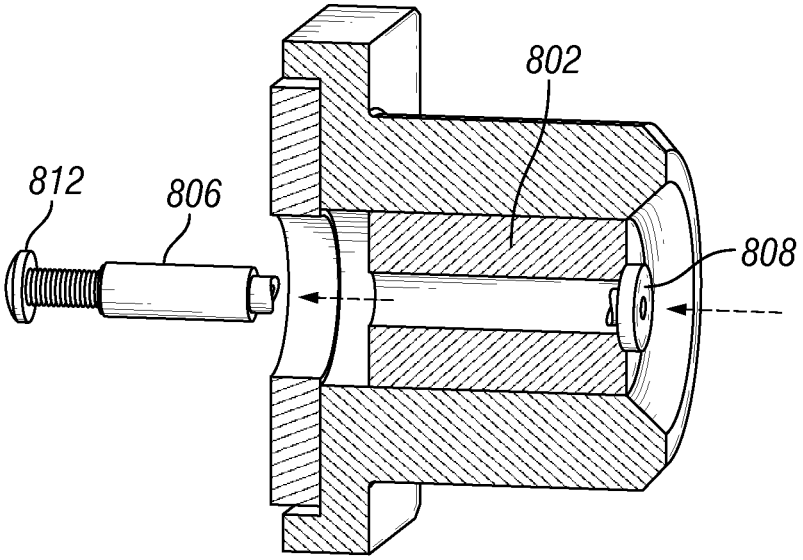
FIG. 9 represents a post-rupture cutaway view of a rupture pin of the present disclosure.

Other mechanical means may be used to secure the rupture pin in the abrasive jetting inserts. For example, a mating piece may be used as an alternative to, or in addition to, the pin fastener described with reference to FIGS. 6-7. FIGS. 8A-B represent a cut-away view of a jet showing assembly of a rupture pin with a mating piece according to one embodiment of the disclosure. FIG. 9 is a cut-away view of a jet showing rupture of a rupture pin previously attached with a mating piece according to one embodiment of the disclosure. In this embodiment, an abrasive jetting insert 802 has a jet into which a rupture pin 804 is inserted. The rupture pin 804 includes a lower portion 806 and an upper portion 808. A mating piece 812 is attached to an end of the rupture pin 804 to hold the rupture pin 804 in the jet. According to one embodiment, the rupture pin 804 may include an opening (not shown) at an end of the lower portion 806 opposite the upper portion 808. The opening allows insertion of the mating piece 812 to secure the rupture pin 804 in the abrasive jet 802. In one embodiment, the opening of the lower portion 806 is threaded to allow the mating piece 812 to screw into the rupture pin 804. The mating piece comprises threads of its own that match the threads of the opening of rupture pin 804. In an alternative embodiment (not shown), an exterior section of lower portion 806 of rupture pin 804 contains threads that match the interior portion of mating piece 812. The surfaces are reversed so that rupture pin inserts into mating piece 812.

The mating piece 812 may provide an opposing force that prevents the rupture pin 804 from falling out the back of the jet of the abrasive jetting insert 802 and into fluid flow. The pin fastener 812, for example, holds the rupture pin 804 in place during transport of the jet perforating tool containing the abrasive jetting insert 802 or during times of low fluid pressure in the jet perforating tool containing the abrasive jetting insert 802. When high pressure builds causing rupture pin 804 to shear, lower portion 806 along with pin fastener 812 are ejected from abrasive jet 802.

A tool with jets and rupture pins as described above may be used in well completion, including initial completion and re-completion. A tool with jets and rupture pins may also be used in other construction phases of a well after a well is drilled, cased, and/or cemented. When the tool is a jet perforating tool as described above, the tool may be used in perforating a well and/or stimulating a well, such as by fracking A tool with rupture pins may also be used in severe tubing and/or well intervention tasks.

According to one embodiment, a jet perforating tool with rupture pins may be used to perforate a well casing. For example, the jet perforating tool may be placed down a well with rupture pins in place. Then, a fluid pressure down the well may be increased to a breaking point of some or all of the rupture pins. When the rupture threshold pressure is reached, the corresponding rupture pins break and fluid flow through the jets begins. The jets may then be used to perforate the well casing, such as by rotating the jet perforating tool to make a partial or complete cut of the well casing.

Placement of the rupture pins in the jet perforating tool allows the jet perforating tool to be placed down the well with other tools to reduce the number of times tools are raised and lowered down the well. For example, the jet perforating tool may be one tool in a line of tools lowered down the well, wherein several of the tools are operated with fluid pressure from the surface. The jet perforating tool has no effect on the other tools in the well and allows fluid to flow through to reach the other tools until the fluid pressure exceeds a rupture pressure threshold. Fluid may flow through the jet perforating tool without activating the perforating jets and flow to other tools in the well. Tasks can be performed with other tools in the well. Then, when desired, fluid pressure is increased to the rupture threshold pressure to break the rupture pins and begin perforation with the jet perforating tool. Other tools may be used before and/or after the jet perforating tool without raising and lowering the tools to remove the jet perforating tool from the well.

In one embodiment, non-abrasive fluid, such as water, is sent down the well to operate the tools in the well. After other functions have been performed with the tools and non-abrasive fluid, the fluid pressure is increased to break the rupture pins after which the non-abrasive fluid is replaced with abrasive fluid for the perforating task. Before switching to abrasive fluid, a status of the jets may be verified as open (e.g., that the rupture pins have broken) to ensure that abrasive fluid does not pass through the perforating tool and damage other tools in the well.

A tool may also include one or more rupture pins configured to break at different fluid pressures. For example, a jet perforating tool may include a first plurality of jets with inserted rupture pins configured to break at a first pressure threshold and may also include a second plurality of jets with inserted rupture pins configured to break at a second pressure threshold different from the first pressure threshold. The perforating tool may be activated by increasing the fluid pressure beyond the first pressure threshold. At a later time, the fluid pressure may be increased beyond the second pressure threshold to active the second plurality of jets on the jet perforating tool.

In one embodiment, the first set of jets may be activated to begin the perforating task. Then, when the first plurality of jets have been worn out, the fluid pressure may be increased to activate the second plurality of jets.

Rupture pins need not only be used with jets configured to perforate. In some cases, it is desirable to circulate fluid through a perforating tool, for example, to remove abrasive slurry from the tool. According to one embodiment disclosed herein, a first plurality of jets may be activated to begin the perforating task. After the perforating task is complete, a second plurality of jets having a larger diameter is then activated to circulate fluid out of the well.

In one embodiment of a method for operating the jet perforating tool in the various embodiments described herein: the initial tool setup may allow fluid to flow through the tool and through any open ports (jets); once the initial task below the sand jet perforating (SJP) tool is complete, additional fluid may be pumped to increase the fluid pressure in the bottom hole assembly (BHA) to the desired pressure; once the fluid pressure is at or above the threshold pressure, the wall of the pin ruptures and the lower portion of the pin is pushed out of the jet, leaving only the upper portion of the pin remaining; fluid may then pass through the upper portion of the inner diameter of the hole in the pin and circulate through the jet decreasing the pressure in the BHA; once the decrease in pressure is noted at the surface, fluid flow may be increased to bring the fluid pressure in the BHA back to the desired pressure; and/or once the fluid is again at the desired pressure, another pin may rupture and as fluid flows through the newly opened jet, the internal fluid pressure may decrease in the BHA. This process may be repeated until all of the jets have been opened. After opening all of the jets, abrasive slurry may be pumped to the tool under pressure for the perforating job. When the abrasive reaches the sand jet perforating tool, the pressurized abrasive may quickly dissolve the upper portion of the pin, leaving no traces of the parts. Depending on the rupture pin material used, this can occur in as little as 30 seconds. Subsequently, the BHA may be pulled from the hole. If preferred, the BHA may be first flushed with non-abrasive fluid.

In various other methods, sets of jets may be opened at lower pressures, then perforating is performed. After perforating, other jets may be opened to increase the flow rate from the tool, such as for a fracturing operation or other high flow application. In yet another method, jets may be placed in multiple tool bodies separated by ball seats. After opening the first set of jets, a ball may be dropped to isolate the active tool from the other tools above. The pressure may then be increased to open a new set of jets and perforating may continue. This may be performed multiple times. One of ordinary skill in the art of abrasive jet perforating or fluid fracking would understand how to use ball seats to seal off one or more levels of abrasive jets. For example, this can be done by varying the inner diameter(s) of the tool such that the ball seats in the inner diameter section of the tool to seal it off.

Other embodiments are disclosed herein. By the nature of their operation, the rupture pins act as a pressure balancing mechanisms inside the jet perforating tool and tubing string. Therefore, in one embodiment, rupture pins are included in a sand jet perforating tool to prevent against pressure spikes that might be caused by a jet blockage, such as where a piece of debris becomes disposed inside the jet perforating tool. For example, a tool could have 4 open jets pumping at a rate of 2 barrels per minute at 2,500 psi. If a piece of debris (metal scale, a piece of rock or gravel) flows through the tubing and is too large to pass through the orifice, it could block the jet. This blockage would cause a spike in pressure that could damage the tool and/or hinder the perforating process. The blocking of the jet, in this example, would decrease the number of perforation holes being cut at one time by 25%, which would in turn raise the pressure within the tool. According to this embodiment, the increase in pressure ruptures another rupture pin set to rupture at a higher pressure, thus opening another jet. The tool could then still function as it was originally intended.

Some of the advantages of the rupture pin described herein and method of operating tool with the rupture pin described herein include: the inner diameter of the sand jet perforating tool contains no moving parts or assemblies, allowing a larger fluid flow path which reduces frictional pressures and erosive wear on the inside of the tool and which reduces mechanical-related failures; no actuator part (e.g., drop ball, conical plug, etc.) is used to open the flow to the jets, which would conventionally involve disconnecting the tubing string at the surface and time to get the actuator part to the tool, and avoids difficulties in circulating in horizontal tubing strings; the rupture pins may be used in any type of tool or setup with little or no modification; rupture pins that rupture at different pressures may also be present in one BHA in order to open for different phases of the operation allowing for greater flexibility in one trip; opening the jets results in fewer trips downhole; overall time to complete the required work is reduced; and/or changes to jet configuration and setup may be made at the well location.

The rupture pins disclosed herein can also be useful in the high pressure cleaning industry. When using high pressure cleaning for tanks, tubes, heat exchangers, and other industry components to be cleaned, jets with rupture pins allow the user to change the flow through said tool by simply increasing the pressure above the threshold of the pin. The increased flow can be used to wash out the debris created in the cleaning process. It would also guard against pressure spikes as described above.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An apparatus, comprising:

a jet perforating tool comprising a plurality of jets; and a first rupture pin inserted in a first jet of the plurality of jets to seal the first jet, wherein the first rupture pin is configured to rupture when a fluid pressure greater than a first threshold pressure is applied to the jet perforating tool, wherein the rupture pin is mechanically attached to the first jet by a pin fastener.

2. The apparatus of claim 1, further comprising a second rupture pin inserted in a second jet of the plurality of jets to seal the second jet, wherein the second rupture pin is configured to rupture when a fluid pressure greater than a second threshold pressure is applied to the jet perforating tool.

3. The apparatus of claim 1, wherein the first rupture pin comprises:

an upper portion; and a lower portion, the lower portion being configured to separate from the upper portion and eject from the jet when the fluid pressure exceeds the first threshold pressure.

4. The apparatus of claim 3, wherein the first rupture pin further comprises an undercut portion between the upper portion and the lower portion, the undercut portion configured to break when the fluid pressure exceeds the first threshold pressure.

5. The apparatus of claim 1, wherein the first jet comprises a threaded jet.

6. The apparatus of claim 1, wherein the first rupture pin comprises material selected from brass, tin, silver, zinc, copper, aluminum, magnesium, gallium, thorium, and gold.

7. An apparatus, comprising:

a jet perforating tool comprising a plurality of jets; and a first rupture pin inserted in a first jet of the plurality of jets to seal the first jet, wherein the first rupture pin is configured to rupture when a fluid pressure greater than a first threshold pressure is applied to the jet perforating tool, wherein the rupture pin is mechanically attached to the first jet by a mating piece.

8. The apparatus of claim 7, further comprising a second rupture pin inserted in a second jet of the plurality of jets to seal the second jet, wherein the second rupture pin is configured to rupture when a fluid pressure greater than a second threshold pressure is applied to the jet perforating tool.

9. The apparatus of claim 7, wherein the first rupture pin comprises:

an upper portion; and a lower portion, the lower portion being configured to separate from the upper portion and eject from the jet when the fluid pressure exceeds the first threshold pressure.

10. The apparatus of claim 9, wherein the first rupture pin further comprises an undercut portion between the upper portion and the lower portion, the undercut portion configured to break when the fluid pressure exceeds the first threshold pressure.

11. The apparatus of claim 7, wherein the first jet comprises a threaded jet.

12. A rupture pin for a jet perforating tool, comprising:

an upper portion; and a lower portion, wherein the upper portion and the lower portion are coupled together by an undercut region, the undercut region having a smaller diameter than the upper portion and the lower portion, and wherein the lower portion comprises an opening configured to receive a mating piece for securing the apparatus into a jet of a jet perforating tool.

13. The rupture pin of claim 12, wherein the undercut region is configured to break when a fluid pressure is applied to the rupture pin that exceeds a first threshold pressure.

14. The rupture pin of claim 12, wherein the rupture pin comprises material selected from the group consisting of brass, tin, silver, zinc, copper, aluminum, magnesium, gallium, thorium, and gold.

15. The rupture pin of claim 12, wherein the upper portion comprises an opening to allow fluid flow through the upper portion.

16. A rupture pin for a jet perforating tool, comprising:

an upper portion; and a lower portion, wherein the upper portion and the lower portion are coupled together by an undercut region, the undercut region having a smaller diameter than the upper portion and the lower portion, wherein the lower portion comprises threads configured to receive a pin fastener for securing the apparatus into a jet of a jet perforating tool.

17. The rupture pin of claim 16, wherein the undercut region is configured to break when a fluid pressure is applied to the rupture pin that exceeds a first threshold pressure.

18. The rupture pin of claim 16, wherein the rupture pin comprises material selected from the group consisting of brass, tin, silver, zinc, copper, aluminum, magnesium, gallium, thorium, and gold.

19. The rupture pin of claim 16, wherein the upper portion comprises an opening to allow fluid flow through the upper portion.

20. A method, comprising:

inserting a jet perforating tool into a well, the jet perforating tool comprising one or more jets, wherein at least one of the one or more jets comprises a first rupture pin;

flowing a first fluid to the jet perforating tool at a first pressure, wherein the first fluid comprises a non-abrasive fluid; and increasing the pressure of the first fluid to a second pressure, wherein the second pressure is greater than a rupture threshold of the first rupture pin.

21. The method of claim 20, further comprising flowing a second fluid to the jet perforating tool after the first rupture pin is ruptured, wherein the second fluid comprises abrasive fluid.

22. The method of claim 20, wherein at least one of the one or more jets comprise a second rupture pin, the method further comprising increasing the pressure of the first fluid to a third pressure, wherein the third pressure is greater than a rupture threshold of the second rupture pin.

* * * * *